US006997116B2

(12) United States Patent
George et al.

(10) Patent No.: US 6,997,116 B2
(45) Date of Patent: Feb. 14, 2006

(54) VERTICALLY HEIGHT ADJUSTABLE KITCHEN TABLE ASSEMBLY

(75) Inventors: Evelyn M. George, Newton, IA (US); M. Michael Khosropour, Newton, IA (US)

(73) Assignee: Maytag Corporation, Newton, IA (US)

( * ) Notice: Subject to any disclaimer, the term of this patent is extended or adjusted under 35 U.S.C. 154(b) by 155 days.

(21) Appl. No.: 10/365,425

(22) Filed: Feb. 13, 2003

(65) Prior Publication Data

US 2004/0159268 A1 Aug. 19, 2004

(51) Int. Cl.
*A47B 9/00* (2006.01)

(52) U.S. Cl. ..... 108/147; 108/50.13

(58) Field of Classification Search ..... 108/44, 108/147, 42, 144.11, 50.13, 50.12; 312/140.1, 312/209, 140.2, 140.3, 246, 247, 312, 229, 312/196, 236, 228, 228.1, 298, 202, 137
See application file for complete search history.

(56) References Cited

U.S. PATENT DOCUMENTS

| | | | | | |
|---|---|---|---|---|---|
| 2,599,020 | A | | 6/1952 | Safstrom | |
| 2,861,857 | A | * | 11/1958 | Lee et al. | 312/312 |
| 3,932,009 | A | | 1/1976 | Zollinger | |
| 4,544,214 | A | * | 10/1985 | Nizel et al. | 312/209 |
| 4,616,887 | A | | 10/1986 | Oudman | |
| 4,635,565 | A | | 1/1987 | Novak | |
| 4,894,600 | A | | 1/1990 | Kearney | |
| 4,969,403 | A | | 11/1990 | Schwartz et al. | |
| 5,323,695 | A | * | 6/1994 | Borgman et al. | 108/147 |
| 5,428,928 | A | * | 7/1995 | Hellwig et al. | 108/147 |
| 5,443,017 | A | * | 8/1995 | Wacker et al. | 108/147 |
| 5,845,587 | A | * | 12/1998 | Ditonto | 108/50.01 |
| 5,909,933 | A | | 6/1999 | Keene et al. | |
| 6,213,575 | B1 | * | 4/2001 | Brin et al. | 312/140.1 |
| 6,286,441 | B1 | | 9/2001 | Burdi et al. | |
| 6,647,899 | B1 | * | 11/2003 | Lysien | 108/24 |

* cited by examiner

*Primary Examiner*—Jose V. Chen
(74) *Attorney, Agent, or Firm*—Diederiks & Whitelaw, PLC

(57) ABSTRACT

A kitchen assembly includes a vertically adjustable dining table capable of selectively shifting to a position depending on consumer requirements. More specifically, the kitchen assembly includes a countertop having a main work surface supported above a first base portion in a substantially horizontal plane and a vertically adjustable tabletop assembly. The tabletop assembly includes a dining surface supported by a plurality of vertically adjustable support members above a second base portion designed to shift the dining table along an adjustment path. A protective apron is arranged between the respective surfaces to prevent foreign objects from entering the adjustment path. Through operation of a control, a user can selectively set the vertical height of the dining table with respect to the countertop. Preferably, the user can set the height of the table through operation of a remote control, irrespective of the presence of objects on the dining surface.

11 Claims, 4 Drawing Sheets

VERTICALLY HEIGHT ADJUSTABLE KITCHEN TABLE ASSEMBLY

BACKGROUND OF THE INVENTION

1. Field of the Invention

The present invention pertains to the art of kitchen assemblies and, more particularly, to a kitchen countertop assembly including a main work surface and a secondary work surface which is vertically adjustable relative to the main work surface.

2. Discussion of the Prior Art

Although countertop assemblies often found in modern day kitchen systems provide various vertically offset planar work surfaces, the surfaces are almost invariably fixed at respective, predetermined heights. Specifically, a typical kitchen will include a main countertop work surface and, perhaps, an upper tabletop which is spaced above the main work surface. In the case of a kitchen island, only the main countertop surface is provided. In many kitchen arrangements, the kitchen island serves as a secondary dining surface depending upon particular requirements and/or design constraints. In any event, such countertop and tabletop assemblies are generally fixed at a fairly standard height that is often established by the height of a cabinet base upon which the surface is supported. Although this height will be fairly standard throughout most residential homes, the height of individuals utilizing the tabletops can vary greatly. More specifically, children, the elderly, tall individuals and individuals constrained to wheelchairs may not find the standard height acceptable to their particular requirements.

The prior art contains several examples of vertically adjustable table systems which enable individuals to tailor the height of a work surface to their particular requirements. However, the prior art systems are generally limited in scope. Specifically, when combined with a main work surface, for example a kitchen island, the upper limit of the table adjustment is constrained to the fixed height of the island work surface. Additionally, in most cases, prior to adjusting the height of the table, foreign objects, such as dishes and the like, must be cleared to enable the adjustment to occur. Finally, the prior art systems provide a single height adjustment control location which may represent an inconvenience to many users and, by extension, limit the versatility of the height adjustment. Particularly, handicapped or other individuals who are unable to readily move about may find that the benefit of gaining access to the height adjustment controls is outweighed by the effort involved.

Therefore, despite the presence of vertically adjustable tables in the prior art, there exists a need in the art for an auxiliary height adjustable dining table which can be vertically adjusted to accommodate a wide range of users. More specifically, there exists a need in the art for a vertically adjustable dining table which can adjust to a position above or below a respective countertop assembly without requiring the removal of foreign objects from the table surface. Finally, there exists a need in the art for an adjustable kitchen table system which can be set to a desired height from a variety of locations.

SUMMARY OF THE INVENTION

The present invention is directed to a kitchen assembly including a vertically adjustable kitchen table capable of selectively shifting to a desired position depending upon the instantaneous need of a user. More particularly, the kitchen assembly includes a countertop having a main work surface that is supported above an island base portion in a substantially horizontal plane. Adjoined to the countertop is a vertically adjustable tabletop assembly. In a preferred arrangement, the tabletop assembly includes a secondary work or dining surface, a tabletop base portion, and a plurality of selectively, vertically adjustable support members. Specifically, the plurality of adjustable support members project from the base portion and interconnect with the secondary work surface. In accordance with a preferred form of the invention, depending on the needs of a particular user, the adjustable support members are capable of selectively shifting the dining surface to a position along an adjustment path extending from a point below the main work surface to a point above the main work surface.

The kitchen assembly of the present invention also preferably includes a protective apron. In one form of the invention, the protective apron interconnects with the tabletop assembly and/or the countertop assembly in a manner which prevents foreign objects from interfering with the vertical adjustment path of the dining surface. More specifically, in accordance with the most preferred form of the invention, the protective apron is arranged on both the dining surface and the main work surface such that foreign objects are prevented from entering an interface area between the respective surfaces during movement along the adjustment path.

The kitchen assembly further includes a control for selecting a desired position for the dining surface. In accordance with the most preferred embodiment, a remote control is provide to enable a user to operate the adjustment mechanism from a variety of locations. Finally, the kitchen assembly includes a control mechanism for providing the motive force to operate the adjustable support members. Preferably, the control mechanism is arranged in the base portion and interconnects the plurality of vertically adjustable support members with the dining surface. More specifically, in accordance with the most preferred form of the invention, a separate control mechanism is located within each support member and further includes a synchronization mechanism which enables the plurality of support members to operate in unison.

With this overall construction, the dining surface can be conveniently positioned by a user such that the dining surface can accommodate a wide range of people having a variety of height requirements. Preferably, the control enables the user to vertically adjust the dining surface without removing foreign objects such as dishes and the like, thereby increasing the versatility of the overall assembly. In any event, additional objects, features and advantages of the present invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
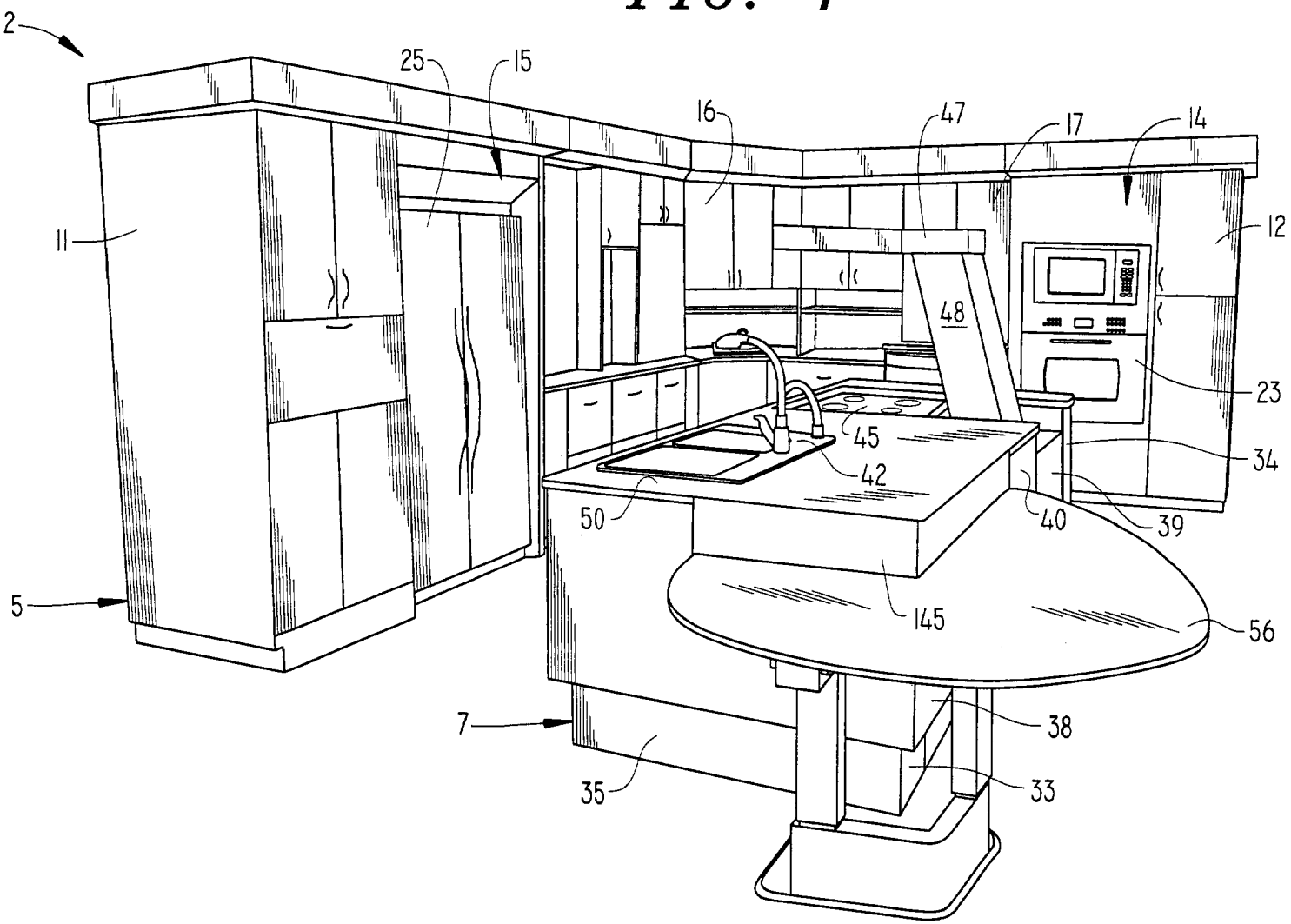
FIG. 1 is a perspective view of an overall modular kitchen system including wall assemblies and a kitchen island assembly incorporating a vertically adjustable table assembly constructed in accordance with the present invention.

With initial reference to FIG. 1, an overall modular kitchen system constructed in accordance with the present invention is generally indicated at 2. As depicted, kitchen system 2 includes both a wall assembly 5 and an island assembly 7. Although details of wall assembly 5 will be provided more fully below, at this point it should at least be recognized that wall assembly 5 is constituted by a plurality of sections constructed from a select arrangement of fixed storage units 11, 12, fixed appliance units 14, 15, and modular appliance and/or storage units 16 and 17 constructed in accordance with the present invention. In the embodiment shown, fixed appliance unit 14 takes the form of a wall oven 23, while fixed appliance unit 15 includes a refrigerator 25. In general, fixed storage units 11 and 12, as well as fixed appliance units 14 and 15, merely complete the overall kitchen assembly. However, these units are not part of the present invention such that no further discussion thereof will be made here.

Particular attention will now be made to FIG. 2 in describing island assembly 7 of kitchen system 2. In the embodiment shown, island assembly 7 includes a pair of laterally spaced and vertically adjustable modular base units 33 and 34. Modular base units 33 and 34 includes vertically adjustable support members 35 and 36 respectively, the details of which will be discussed more fully below. Interposed and interconnected to base units 33 and 34 are a plurality of modular appliance units 38 and 39, as well as a modular storage unit 40.

As shown, modular appliance unit 38 constitutes a sink module including an associated sink 42, modular appliance unit 39 constitutes a cooking module including a cooktop 45 and an adjustable cooktop vent hood 47 mounted on a vertically and horizontally extending support 48, and modular storage unit 40 defines cabinetry. As shown in this figure, kitchen island 7 also includes a countertop 50 secured atop base units 33, 34, appliance units 38, 39 and storage unit 40, thereby serving as a working surface. Countertop or work surface 50 is of a type generally known in the art, such as a laminate, CORIAN, granite or the like. An island tabletop assembly 56 is arranged directly adjacent to, but preferably separate from, kitchen island 7. As will be detailed more fully below, tabletop assembly 56 can be vertically adjusted relative to kitchen island 7.

Arranged about and serving as a finish covering for wall and island assemblies 5 and 7 are a plurality of decorative sheathing panels, one of which is generally indicated at 62. Sheathing panels 62 are sized in accordance with the particular design of modular kitchen assembly 2. Alternatively, each module can preferably include one or more associated sheathing panels 62 such that custom sizing is not required. In any event, sheathing panels 62 are provided as a finishing touch to the overall modular kitchen system 2, with the actual design, type and nature being left up to the particular preferences of the consumer.

Figure 2:
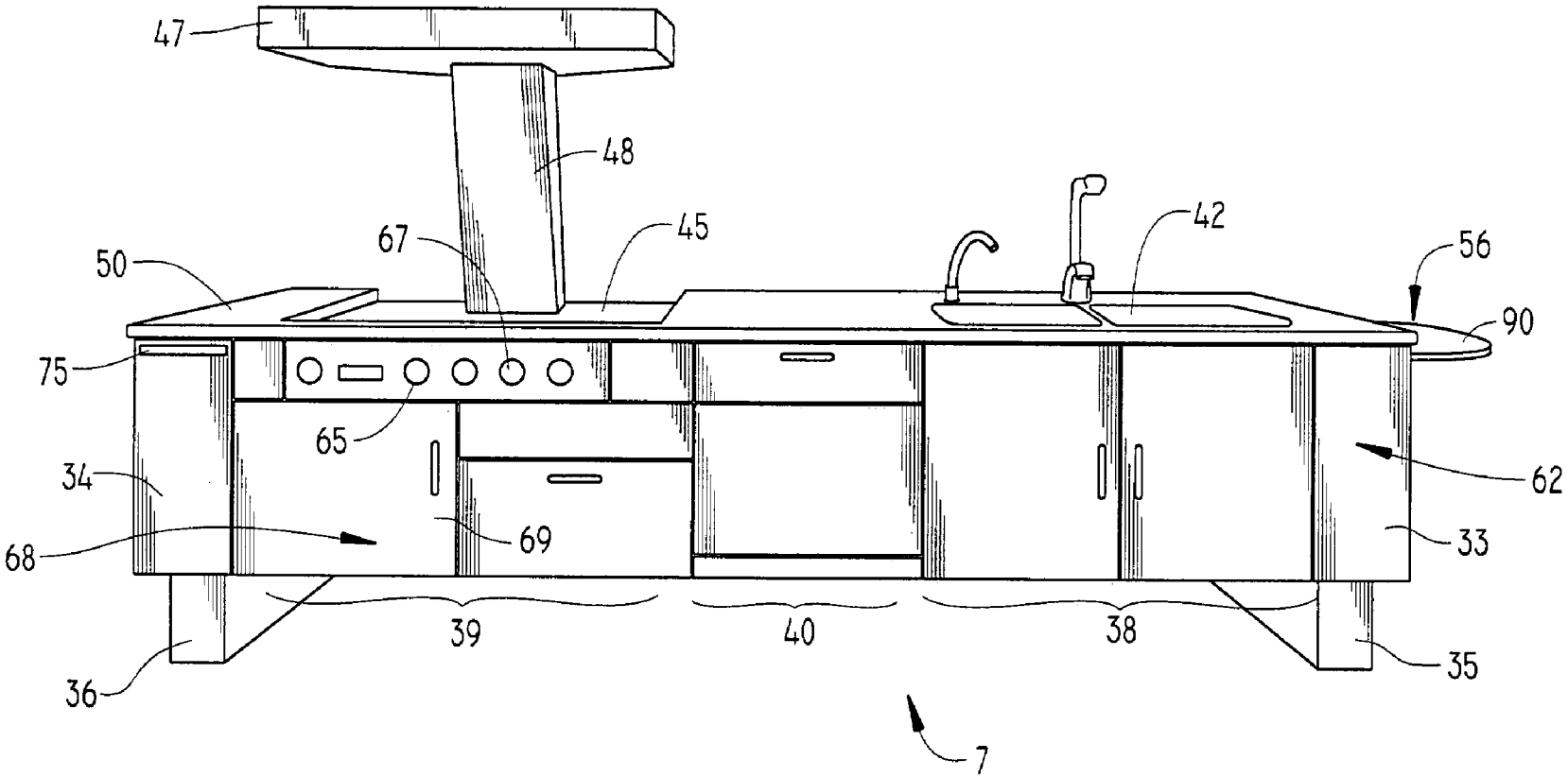
FIG. 2 is an enlarged perspective view of the kitchen island assembly of FIG. 1.

Referring further to FIG. 2, modular appliance unit 39 will be described with more detail. As set forth above, appliance unit 39 includes a cooktop 45 arranged within an upper portion of modular appliance unit 39. Arranged on a front surface of appliance unit 39 is a control panel 65 including a plurality of control members 67 provided to selectively activate heating elements (not shown) arranged about cooktop 45. In addition to carrying cooktop 45, appliance unit 39 includes a plurality of storage units, as generally indicated at 68, having associated therewith door assemblies 69. Storage units 68 are provided to establish storage space for pots, pans, griddles and the like.

In a preferred form of the invention, a control drawer 75 having associated therewith a control unit 77 (see FIG. 3) including a synchronization module 79, the details of which will be set forth more fully below, is arranged on an upper portion of base unit 34. Control drawer 75 is preferably constituted by a slide-out drawer similar to the type used for compact disc players. However, it should be understood that control unit 77 could be arranged on or recessed within an exposed surface of kitchen island 7.

The actual construction and use of modular kitchen system 2 in connection with vertically adjusting both wall cabinet assembly 5 and kitchen island assembly 7 is described in co-assigned U.S. Patent Application entitled "MODULAR KITCHEN SYSTEM" filed on even date herewith and incorporated herein by reference. As indicated above, the present invention is particularly directed to accommodating vertical adjustability in connection with tabletop assembly 56 and, more specifically, to the particular configuration of tabletop assembly 56 in relation to kitchen island 7.

Figure 3:
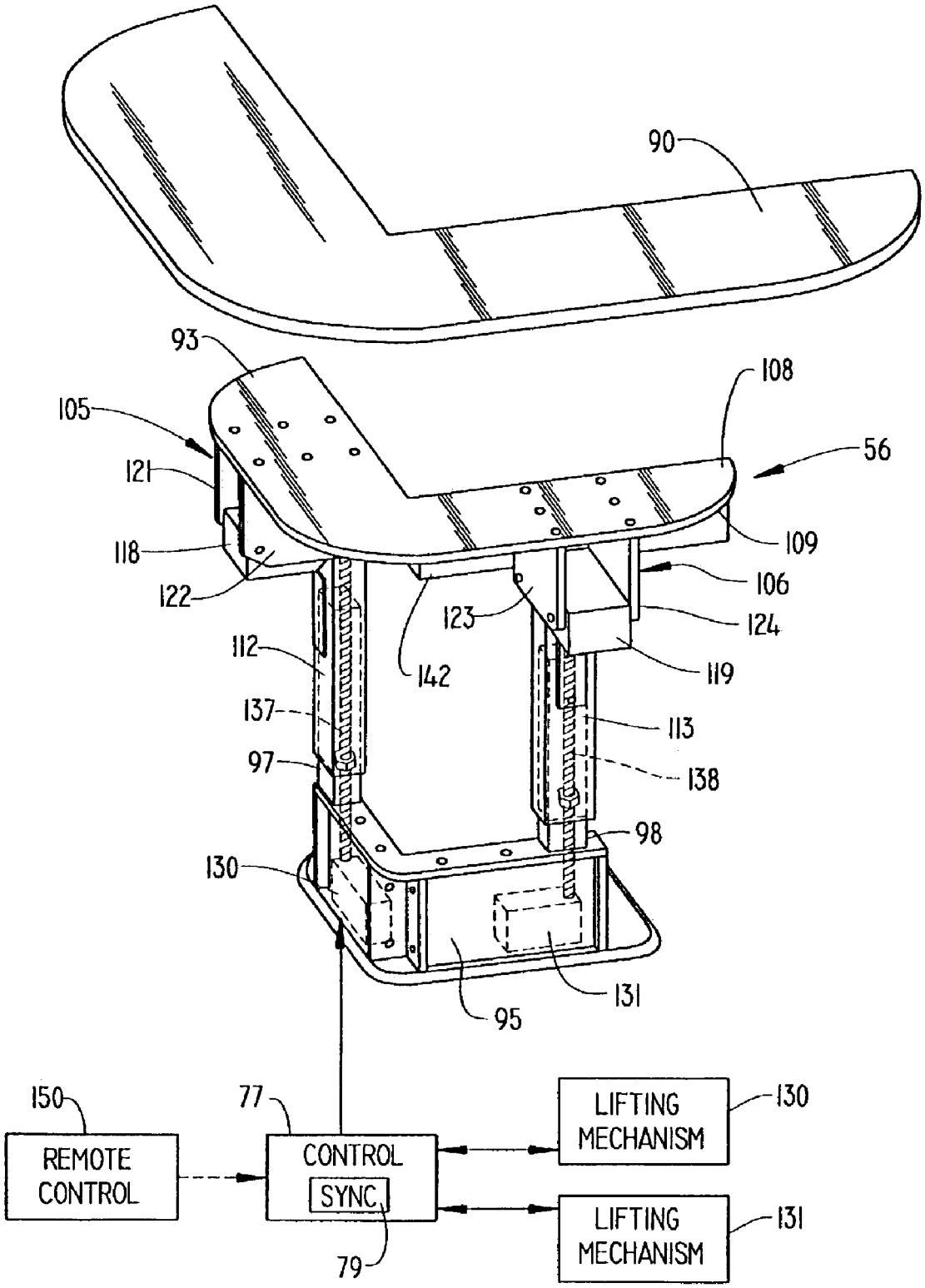
FIG. 3 is an exploded view of the vertically adjustable table assembly including a schematic view of a control system employed in accordance with the present invention.

In a preferred form of the invention, as shown in FIG. 3, tabletop assembly 56 includes a secondary work surface or dining table 90 mounted on a table support 93, a table base unit 95, and a plurality of support legs 97 and 98. As shown, support legs 97 and 98 interconnect base unit 93 to table support 93 through respective lifting assemblies 105 and 106. Specifically, table support surface 93 includes an upper surface 108 upon which table 90 is secured, and a lower surface 109 attached to lifting assemblies 105 and 106. In accordance with the invention, dining table 90 can be formed from a variety of materials, including a Formica covered wood panel, granite, CORIAN or the like, and is preferably secured to support surface 93 through an adhesive and/or a plurality of mechanical fasteners (not shown). However, in the event that dining table 90 is formed from glass, acrylic or the like, an aluminum interface plate (not shown) is preferably interposed between support surface 93 and dining table 90.

In accordance with one form of the present invention, support legs 97 and 98 support dining table 90 in a substantially horizontal plane while providing a mechanism through which table 90 can be shifted along a vertical path. More specifically, lifting assemblies 105 and 106 are adapted to vertically transport dining table 90 through telescoping leg members 112 and 113 carried by support legs 97 and 98. As shown, lifting assemblies 105 and 106 include respective lifting supports 118 and 119. Preferably, each lifting support 118, 119 includes a plurality of support gussets 121, 122 and 123, 124 respectively, which provide stability to table 90. Specifically, support gussets 121–124 interconnect lifting supports 118 and 119 to lower surface 109 of table support surface 93. More specifically, arranged within base unit 95 are respective lifting mechanisms 130 and 131 which are operatively connected to respective linear actuators 137 and 138 used to provide the motive force needed to move lifting assemblies 105 and 106 along an adjustment path. Preferably, linear actuators 137 and 138 are constituted by electrically driven worm screw assemblies of a type known in the art. However, other forms of linear actuators, such as electrically drivegear assemblies, hydraulic lifts, pneumatic lifts, to the like, could also be employed.

Figure 4:
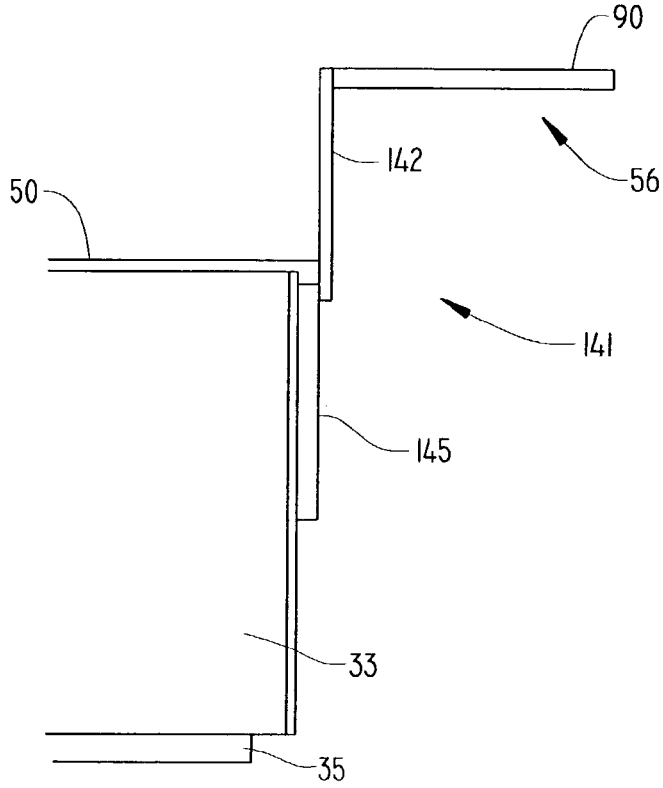
FIG. 4 is a partial perspective view of the kitchen island of FIG. 2 depicting the table assembly of the present invention shifted to a maximum height adjustment position.
Figure 5:
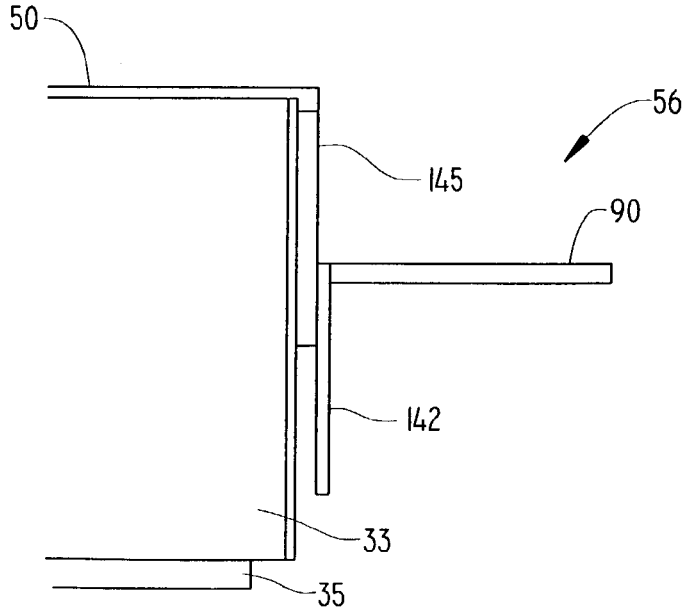
FIG. 5 is a partial perspective view of the kitchen island of FIG. 2 depicting the table assembly of the present invention shifted to a minimum height adjustment position.

Referring to FIG. 4, tabletop assembly 56 is shown raised to a maximum height position along the adjustment path. As depicted, a protective apron system 141 is preferably positioned between tabletop assembly 56 and modular base unit 33. Apron system 141 is arranged to prevent foreign objects from entering between countertop 50 and table 90 as table 90 shifts between selected height positions. Preferably, apron system 141 constitutes a table apron 142 and an island apron 145. As shown, when table 90 is raised to a level above countertop 50, table apron 142 prevents foreign objects located on countertop 50 from entering the interface between countertop 50 and table 90. Similarly, when table 90 is lowered to a level below countertop 50, as best seen in FIG. 5, island apron 145 prevents objects located on table 90 from falling between apron 142 and a side portion of island 7.

In accordance with the most preferred form of the present invention, tabletop assembly 56 includes a remote control unit 150 (see FIG. 3) constituted by a hand-held infrared unit which is used to selectively shift table 90 to desired positions along the adjustment path without requiring access to control drawer 75. Preferably, remote control 150 operates in conjunction with control unit 77 to selectively raise or lower table 90 according to individual requirements. As indicated above, control unit 77 includes synchronization module 79 adapted to control the simultaneous adjustment of lifting mechanisms 130 and 131. In this manner, lifting mechanisms 130 and 131 operate in unison to raise or lower table 90, while maintaining table 90 in a substantially horizontal plane. Accordingly, the consumer can shift table 90 along without having to remove dishes and the like from table 90.

Although described with reference a preferred embodiment of the invention, it should be readily understood that various changes and/or modifications can be made to the invention without departing from the spirit thereof. For instance, while the figures depict a specific arrangement of the kitchen assembly, it should be understood that the invention enables the construction of a wide variety of differently configured kitchen assemblies. In addition, although the table assembly is shown to include a one piece table base unit, each support leg can be separated into individual supports and, by itself, constitute a base unit such that the support members are not interconnected through a single base. Also, while the table assembly is shown adjoined to the kitchen island assembly, it should be apparent that the table assembly could be incorporated into the wall of FIG. 1 assembly. In general, the invention is only intended to be limited by the scope of the following claims.

We claim:

1. A kitchen assembly comprising:

a countertop including a main work surface said main work surface having one of a sink and cooktop;

a first base portion for supporting the main work surface in a substantially horizontal plane;

a tabletop assembly adjoined to the countertop, said tabletop assembly including a dining surface, a second base portion and a plurality of selectively, vertically adjustable support members projecting from the second base portion and interconnected with the dining surface, said support members being extensible to enable the dining surface to be selectively shifted between an upper position located above the main work surface and a lower position located below the main work surface; and a control mechanism interconnected with the vertically adjustable support members wherein, upon activation, the control mechanism adjusts the support members to shift the dining surface to a desired position, ranging from the upper position to the lower position, relative to the main work surface.

2. The kitchen assembly according to claim 1, further comprising: a first protective apron, connected to one of the tabletop assembly and the countertop, for preventing foreign objects from interfering with a vertical shift of the dining surface relative to the main work surface.

3. The kitchen assembly according to claim 2, wherein the first protective apron is interconnected with the tabletop assembly.

4. The kitchen assembly according to claim 3, further comprising: a second protective apron interconnected with the countertop assembly, said second protective apron being adapted to shift relative to the tabletop assembly such that foreign objects cannot enter an interface area between the main and dining surfaces.

5. The kitchen assembly according to claim 1, wherein the control mechanism includes a remote control adapted to emit a signal from a remote location indicating a desired vertical adjustment of the dining surface.

6. The kitchen assembly according to claim 1, further comprising: a plurality of telescoping members carried by the support members, said telescoping members being selectively moveable relative to the support members such that, upon activation of the control, the telescoping members supply a motive force to the dining surface.

7. The kitchen assembly according to claim 6, further comprising: a linear actuator arranged within each of the telescoping members, said linear actuators being adapted to vertically shift the dining surface relative to the second base member through the support members.

8. The kitchen assembly according to claim 7, wherein each linear actuator constitutes an electrically driven worm screw assembly.

9. The kitchen assembly according to claim 7, wherein the linear actuators are synchronized such that the plurality of support members shift in unison in order to maintain the tabletop in a substantially horizontal configuration during repositioning.

10. The kitchen assembly according to claim 7, wherein the countertop is part of a kitchen island.

11. The kitchen assembly according to claim 10, wherein the tabletop extends around a corner of the kitchen island.

* * * * *